US008115723B2

(12) United States Patent
Hung et al.

(10) Patent No.: US 8,115,723 B2
(45) Date of Patent: Feb. 14, 2012

(54) DRIVING CIRCUIT FOR DISPLAY PANEL

(75) Inventors: Der-Ju Hung, Tucheng (TW); Cheng-Chung Yeh, Taipei (TW)

(73) Assignee: Sitronix Technology Corp., Hsinchu County (TW)

( * ) Notice: Subject to any disclaimer, the term of this patent is extended or adjusted under 35 U.S.C. 154(b) by 516 days.

(21) Appl. No.: 12/413,673

(22) Filed: Mar. 30, 2009

(65) Prior Publication Data

US 2010/0245314 A1 Sep. 30, 2010

(51) Int. Cl.
*G09G 3/36* (2006.01)

(52) U.S. Cl. ..... 345/98; 345/211

(58) Field of Classification Search ..... 345/87–100, 345/204, 211

See application file for complete search history.

(56) References Cited

U.S. PATENT DOCUMENTS 6,549,196 B1 * 4/2003 Taguchi et al. ..... 345/210
6,633,271 B1 * 10/2003 Motegi et al. ..... 345/87
6,653,999 B2 * 11/2003 Motegi et al. ..... 345/100
6,831,620 B1 * 12/2004 Nishikubo et al. ..... 345/87
7,049,756 B2 * 5/2006 Aiba et al. ..... 315/172
7,307,610 B2 * 12/2007 Sakaguchi ..... 345/89
7,477,227 B2 * 1/2009 Hashimoto ..... 345/100
7,573,416 B1 * 8/2009 Ren et al. ..... 341/155
2002/0093475 A1 * 7/2002 Hashimoto ..... 345/87

* cited by examiner

*Primary Examiner* — Nitin Patel
(74) *Attorney, Agent, or Firm* — Ming Chow; Sinorica, LLC

(57) ABSTRACT

The present invention relates to a driving circuit for a display panel, which comprises a pre-charge power supply, a pre-charge switch, a buffer circuit, and a plurality of resistive devices. The pre-charge switch is coupled between the pre-charge power supply and a capacitor of the display panel. The buffer circuit is used for buffering a data signal and producing a buffer signal. The plurality of resistive devices is connected in series and coupled to the buffer circuit, and produces a plurality of driving signals therebetween according to the buffer signal. The driving circuit first closes the pre-charge switch to make the pre-charge power supply charge the capacitor. Then, one of the plurality of driving signals charges the capacitor. Thereby, the driving time can be shortened, and power of the display can be saved by avoiding power consumption on resistors.

11 Claims, 7 Drawing Sheets

DRIVING CIRCUIT FOR DISPLAY PANEL

FIELD OF THE INVENTION

The present invention relates to a driving circuit, and particularly to a driving circuit for a display panel.

BACKGROUND OF THE INVENTION

Modern technologies develop prosperously. Information products are introduced continuously to satisfy varied demands of numerous people. Most of early displays are cathode ray tubes (CRTs). However, their size is huge and their power consumption is great. In addition, the radiation they produced may endanger the health of long-term users. Thereby, current displays in the market are gradually replaced by liquid crystal displays (LCDs). LCDs have the characteristics of lightness, thinness, shortness, and smallness. Besides, they also have the advantages of low radiation and power consumption. Hence, they have become the mainstream of the market.

LCDs display images by controlling the light transmittance of liquid-crystal cells according to data signals. Because active-matrix LCDs adopt active control switches, the LCDs of this sort own advantages in displaying motion pictures. Thin-film transistors (TFTs) are switches mainly used in active-matrix LCDs.

FIG. 1 shows a schematic diagram of the driving system for an LCD according to the prior art. As shown in the figure, the driving system comprises a display panel 10', a scan driving circuit 12', a data driving circuit 14', a timing control circuit 16', and a circuit for producing reference voltages 18'. The display panel 10' is used for displaying images. The scan driving circuit 12' is used for producing and transmitting a scan signal to the display panel 10' for driving a thin-film transistor (TFT) of the display panel 10'. The data driving circuit 14' is used for producing and transmitting a data signal to the display panel 10' for displaying the images. The timing control circuit 16' produces a timing control signal, and transmitting the timing control signal to the scan driving circuit 12' and the data driving circuit 14', respectively, for controlling the scan driving circuit 12' and the data driving circuit 14' to transmit the scan signal and data signal to the display panel 10', respectively, and for displaying the images. In addition, the circuit for producing reference voltages 18' produces a reference voltage and transmits the reference voltage to the data driving circuit 14' for making the data driving circuit 14' to produce the data signal according to the timing control signal and the reference voltage.

FIG. 2 shows a schematic diagram of a circuit for producing reference voltages according to the prior art. If the digital display data corresponding to RGB is comprised by, for example, 6 bits, the circuit for producing reference voltages 18' can output 64 analog voltages V0~V63 corresponding to $2^6$=64 grayscales. The circuit for producing reference voltage 18' is comprised by resistive voltage division circuit including resistors R0~R7 connected in series. Each of the resistors R0~R7 is further comprised by 8 resistors connected in series. As shown in FIG. 3, the 8 resistors R01~R08 are connected in series to form the resistor R0. Other resistors R1~R7 are formed similarly. Thereby, the circuit for producing reference voltages 18' is comprised by 64 resistors and produces voltages V0~V63.

However, because 64 resistors are needed to produce 64 different voltage levels, the area of the circuit for producing reference voltages 18' is increased, and hence increasing the area of the display. Besides, in order to reduce the area of the circuit for producing reference voltages 18', resistors with larger resistance have to be used, which will affect the driving capability of the data driving circuit 14'. Moreover, when the data driving circuit 14' drives the display panel 10' via the resistors, a large amount of power will be consumed on the resistors, and thus wasting power of the display.

Accordingly, the present invention provides a novel driving circuit for a display panel, which can reduce the amount of resistors used without sacrificing the driving capability of the data driving circuit 14'. Thereby, the area of the display can be reduced, and the power of the display can be saved.

SUMMARY

An objective of the present invention is to provide a driving circuit for a display panel, which uses a pre-charge power supply to charge a capacitor of the display in advance for shortening the driving time.

Another objective of the present invention is to provide a driving circuit for a display panel, which uses a pre-charge power supply to charge a capacitor of the display in advance for saving power of the display by avoiding power consumption on resistors.

The driving circuit for a display panel according to the present invention comprises a pre-charge power supply, a pre-charge switch, a buffer circuit, and a plurality of resistive devices. The pre-charge switch is coupled between the pre-charge power supply and a capacitor of the display panel. The buffer circuit is used for buffering a data signal and producing a buffer signal. The plurality of resistive devices is connected in series and coupled to the buffer circuit, and produces a plurality of driving signals therebetween according to the buffer signal. The driving circuit first closes the pre-charge switch to make the pre-charge power supply charge the capacitor. Then, one of the plurality of driving signals charges the capacitor. Thereby, the driving time can be shortened, and power of the display can be saved by avoiding power consumption on resistors.

DETAILED DESCRIPTION

In order to make the structure and characteristics as well as the effectiveness of the present invention to be further understood and recognized, the detailed description of the present invention is provided as follows along with preferred embodiments and accompanying figures.

Figure 1:
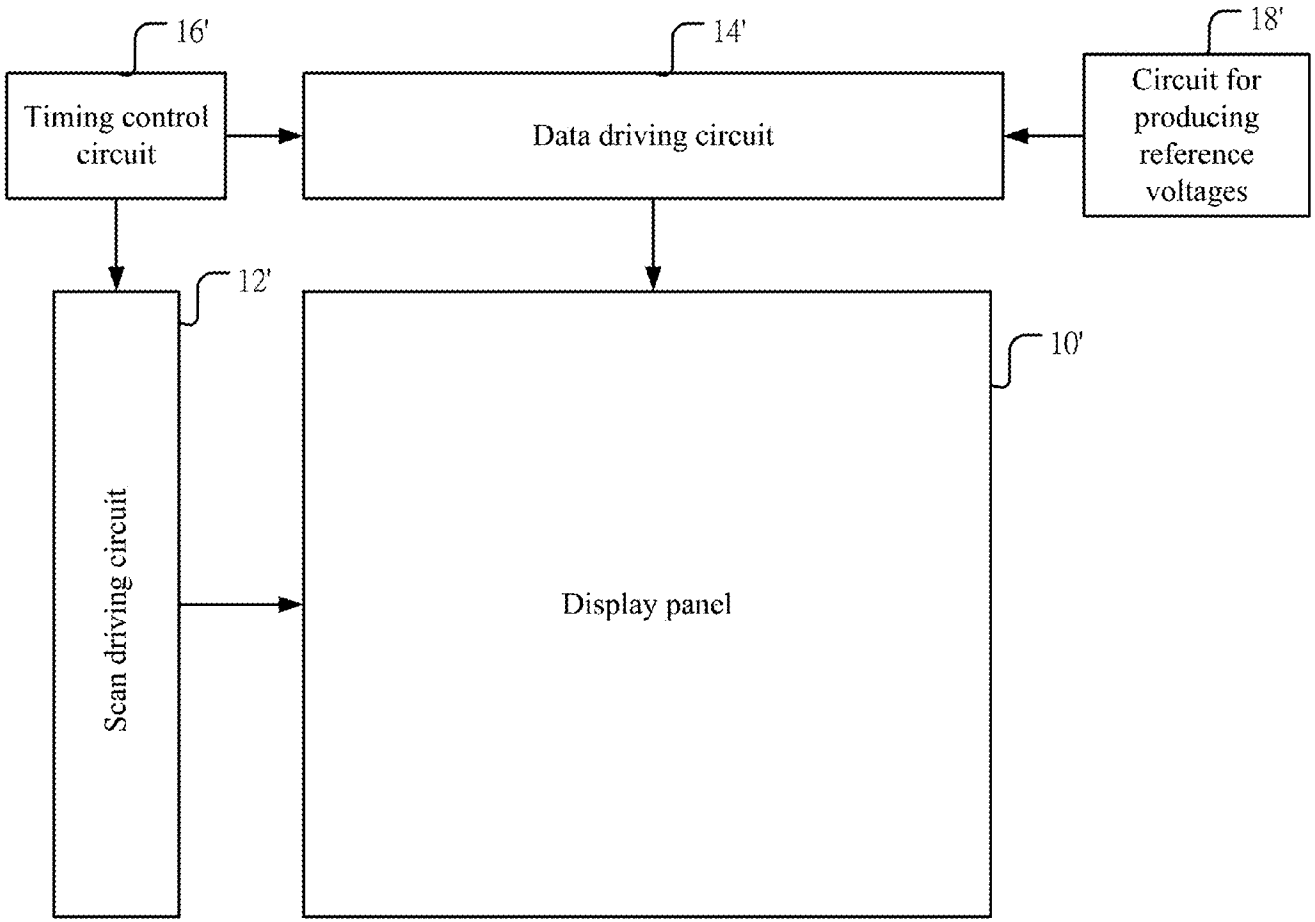
Figure 1(Prior Art)
FIG. 1 shows a schematic diagram of the driving system for an LCD according to the prior art.
Figure 2:
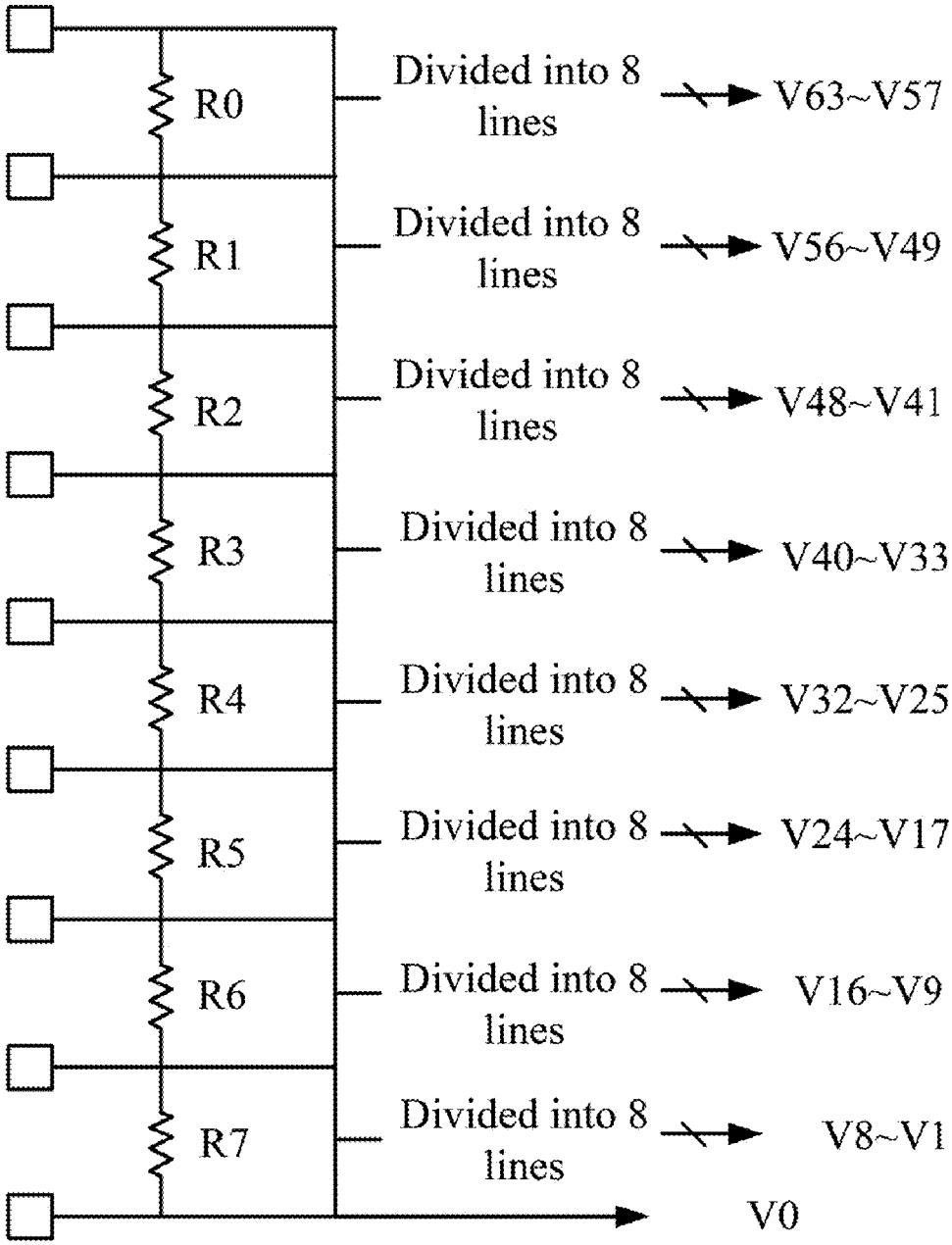
Figure 2(Prior Art)
FIG. 2 shows a schematic diagram of a circuit for producing reference voltages according to the prior art.
Figure 3:
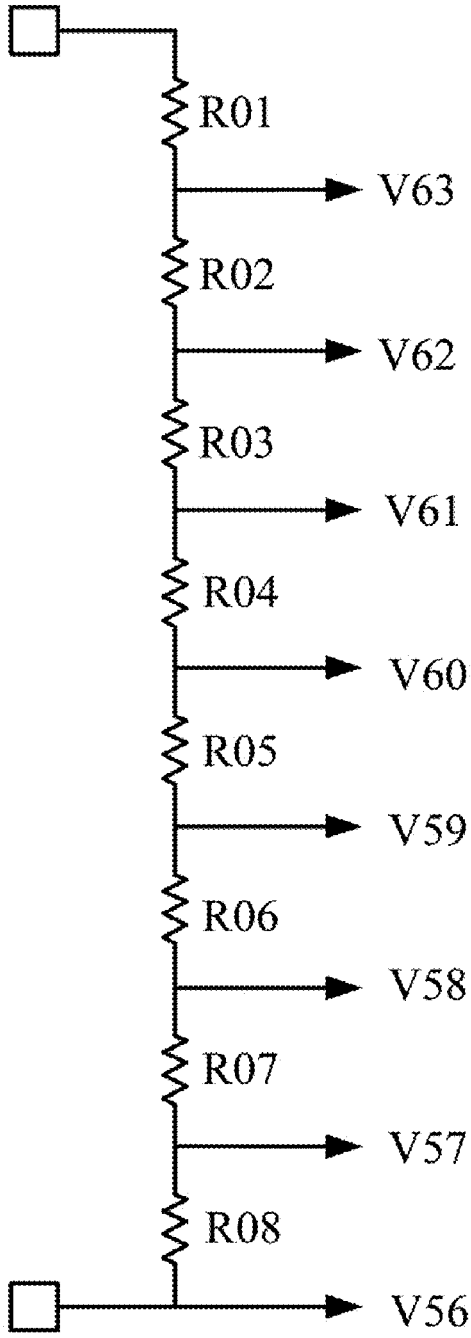
Figure 3(Prior Art)
FIG. 3 shows a schematic diagram of a detailed circuit for producing reference voltages according to the prior art.
Figure 4:
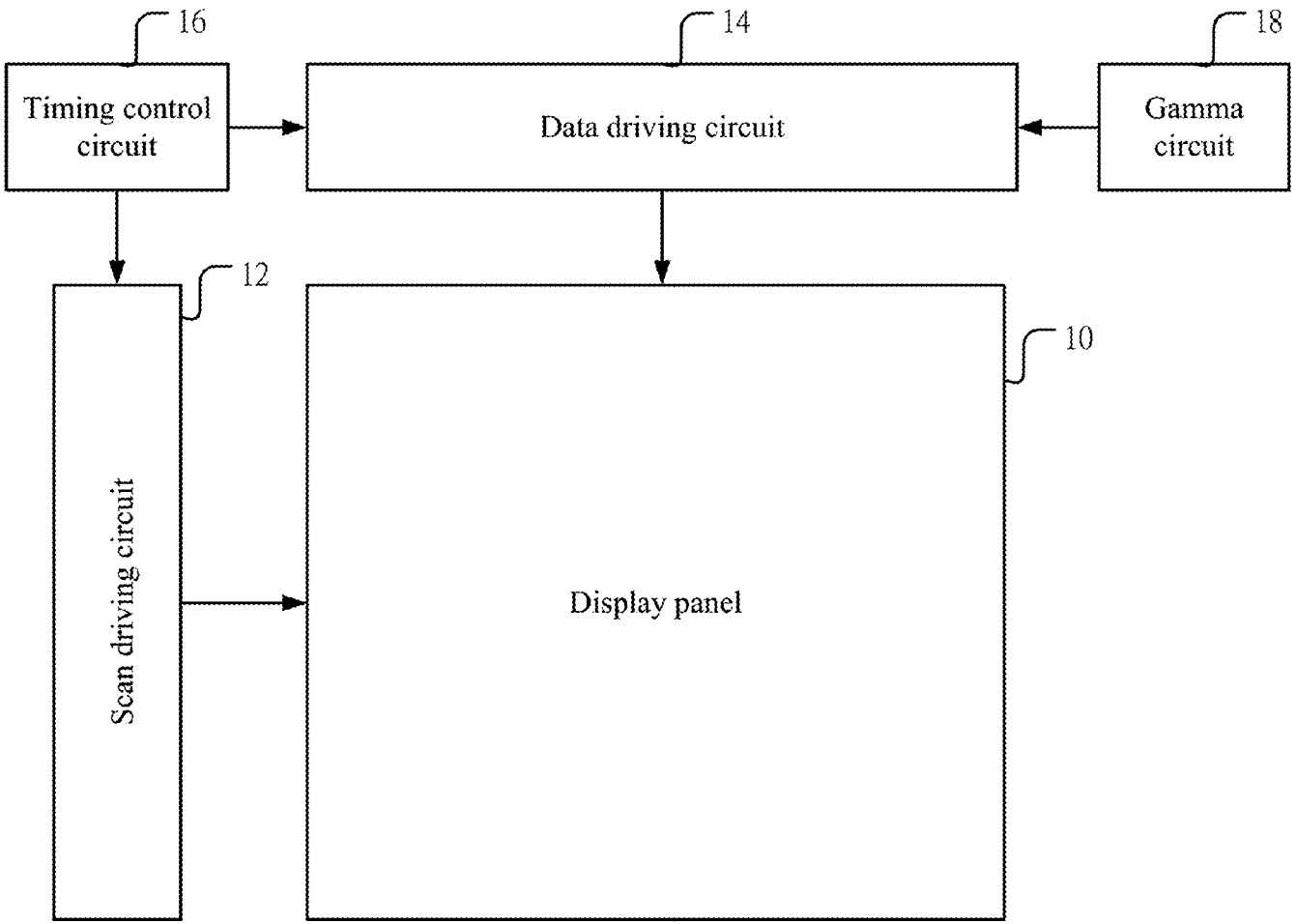
FIG. 4 shows a schematic diagram of the driving system for an LCD according to a preferred embodiment of the present invention.

FIG. 4 shows a schematic diagram of the driving system for an LCD according to a preferred embodiment of the present invention. As shown in the figure, the driving system comprises a display panel 10, a scan driving circuit 12, a data driving circuit 14, a timing control circuit 16, and a Gamma circuit 18. The display panel 10 is used for display images. The scan driving circuit 12 is used for producing and transmitting a scan signal to the display panel 10 to drive a thin-film transistor (TFT) of the display panel 10. The data driving circuit 14 is used for producing and transmitting a data signal to the display panel 10 to display the images according to the data signal. The timing control circuit 16 produces a timing control signal and transmits the timing control signal to the scan driving circuit 12 and the data driving circuit 14 for controlling the scan driving circuit 12 and the data driving circuit 14 to transmit the scan signal and data signal to the display panel 10, respectively. Thereby, the images can be displayed. In addition, the Gamma circuit 18 produces a reference voltage and transmits the reference voltage to the data driving circuit 14. Hence, the data driving circuit 14 can produce the data signal according to the timing control signal and the reference voltage.

Figure 5:
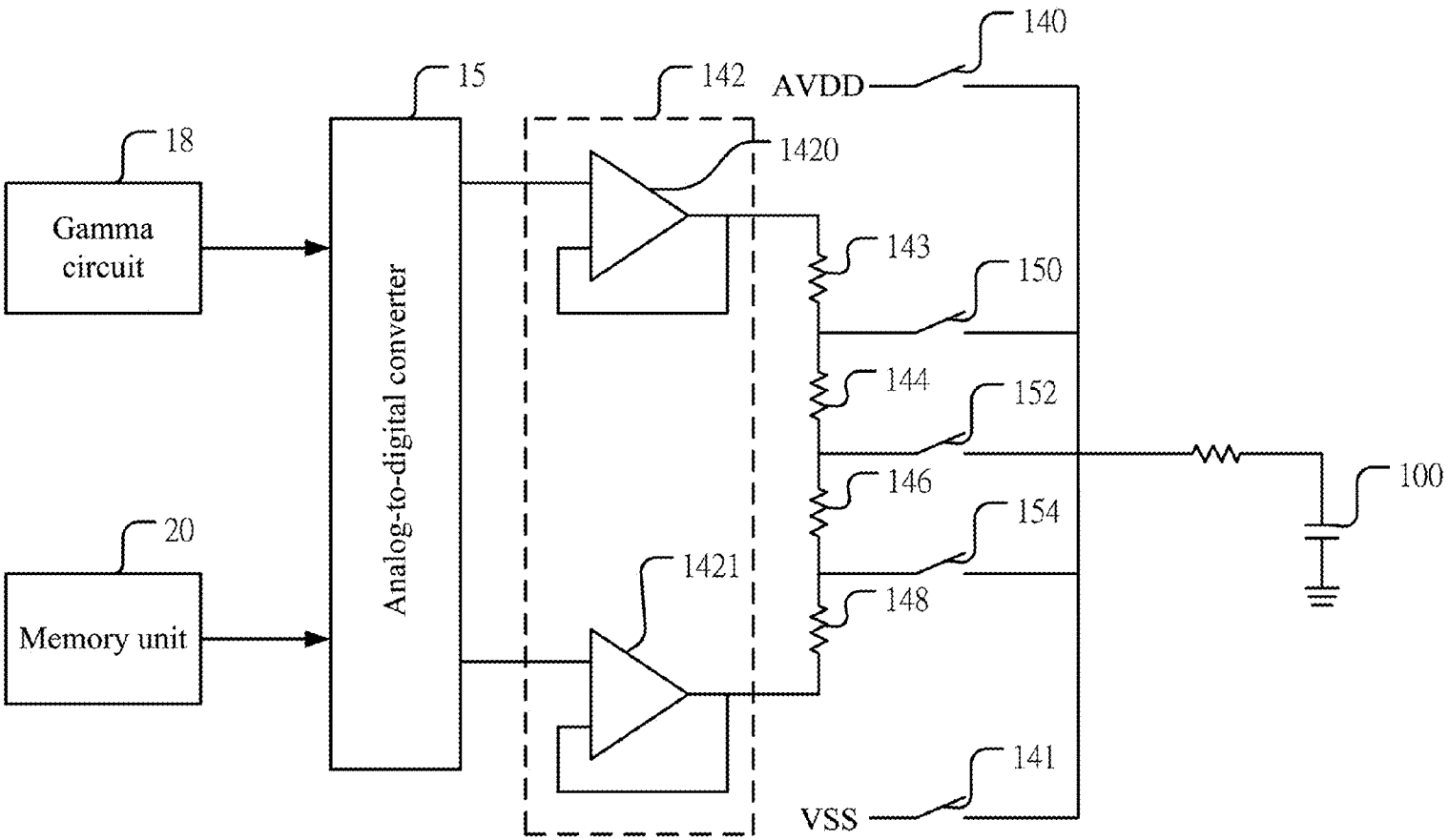
FIG. 5 shows a block diagram according to a preferred embodiment of the present invention.
Figure 6:
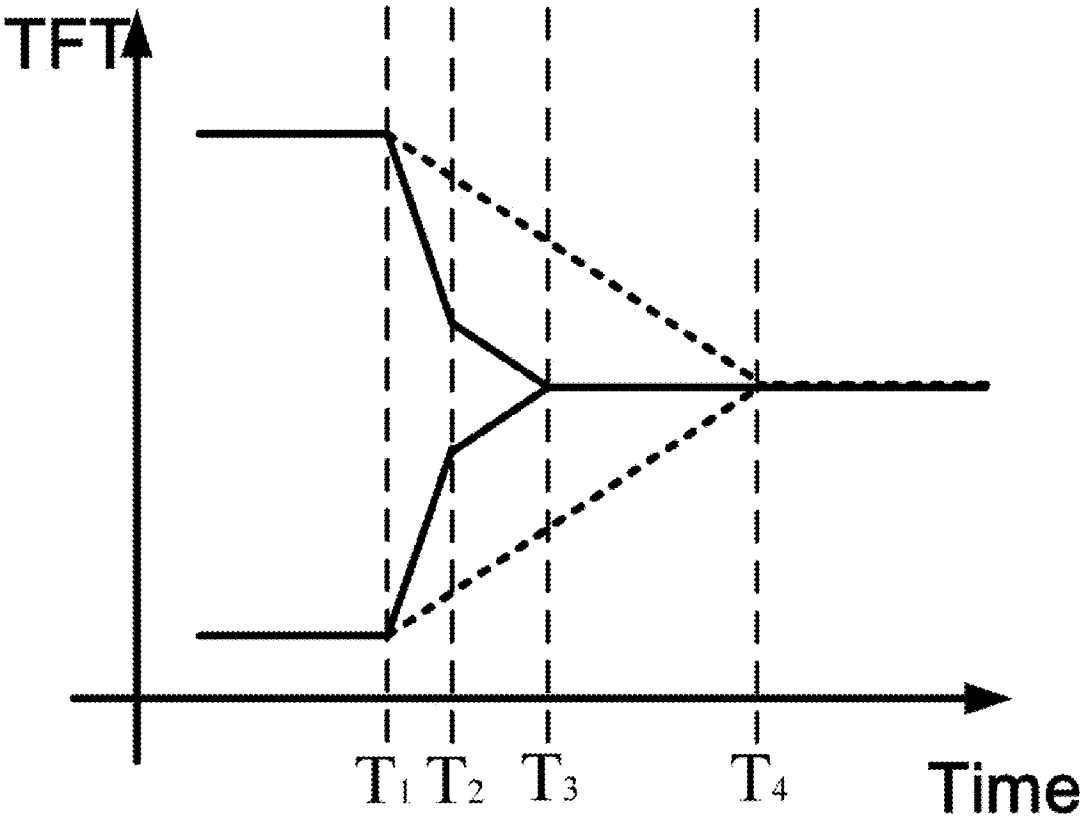
FIG. 6 shows a timing diagram of driving according to a preferred embodiment of the present invention.

FIG. 5 shows a block diagram according to a preferred embodiment of the present invention. As shown in the figure, the driving circuit for a display panel according to the present invention is applied to the data driving circuit 14 for receiving 64 voltage levels produced by the Gamma circuit 18. Because the driving circuit according to the present invention can receive 8-bit signals, the data driving circuit 14 needs to use 8 driving circuits for receiving and processing said 64 voltage levels. According to the present preferred embodiment, only one driving circuit is used for description. The driving circuit according to the present invention comprises a first pre-charge power supply AVDD, a first pre-charge switch 140, a buffer circuit 142, and a plurality of resistive devices 143, 144, 146, 148. The first pre-charge switch 140 is coupled between the pre-charge power supply AVDD and a capacitor 100 of the display panel. The buffer circuit 142 is used for buffering a data signal and producing a buffer signal. The plurality of resistive devices 143, 144, 146, 148 is connected in series and coupled to the buffer circuit 142, and produces a plurality of driving signals therebetween according to the buffer signal. The driving circuit first closes the pre-charge switch to make the pre-charge power supply charge the capacitor 100. Then, one of the plurality of driving signals charges the capacitor 100. FIG. 6 shows a timing diagram of driving according to a preferred embodiment of the present invention. As shown in the figure, the dashed line represents that the driving circuit does not pre-charge the capacitor 100, and the solid line represents that the driving circuit pre-charges the capacitor 100. It is known by the figure that the driving circuit according to the present invention charges the capacitor 100 using the first pre-charge power supply AVDD during the time interval T1 to T2. During the time interval T2 to T3, the driving signal is used to charge the capacitor 100. Thereby, the driving circuit according to the present invention completes driving the display panel 10 at time T3, shortening the time the driving circuit charges the capacitor 100. Hence, the driving time of the display panel 10 by the data driving circuit 14 is shortened, and the efficiency of the display is improved. In addition, because the time the driving circuit charges the capacitor 100 is shortened, power can be saved by avoiding power consumption on the plurality of resistive devices 143, 144, 146, 148, where the resistive device is a resistor.

In addition, the driving circuit according to the present invention further comprises an analog-to-digital converter 15 used for converting an input signal and producing the data signal. The analog-to-digital converter 15 is coupled to the Gamma circuit 18 for receiving correction data produced by the Gamma circuit 18 as the input signal. The Gamma signal 18 produces the correction data according to a Gamma curve. Besides, the analog-to-digital converter 15 is further coupled to a memory unit 20, which is used for storing a plurality of pixel data. The analog-to-digital converter 15 receives the plurality of pixel data and the correction data as the input signal and produces the data signal. The memory unit 20 is a random access memory (RAM).

Referring back to FIG. 5, a first switch 150, a second switch 152, and a third switch 154 are set between the plurality of resistive devices 143, 144, 146, 148. The analog-to-digital converter can produce a control signal according to the pixel data stored in the memory unit 20 for closing/opening the first switch 150, the second switch 152, or the third switch 154. Besides, the analog-to-digital converter 15 can first control the first pre-charge switch 140 or the second pre-charge switch 141 to close for charging the capacitor 100. After a period of time, the analog-to-digital converter 15 can control the first pre-charge switch 140 or the second pre-charge switch 141 to open, and close one of the first switch 150, second switch 152, and third switch 154 for charging the capacitor 100 in succession.

Furthermore, the buffer circuit 142 includes a first buffer 1420 and a second buffer 1421. The first buffer 1420 is used for buffering the data signal and producing a first buffer signal; the second buffer 1421 is used for buffering the data signal and producing a second buffer signal. The plurality of resistive devices 143, 144, 146, 148 produces the driving signal according to the voltage difference between the first buffer signal produced by the first buffer 1420 and the second buffer signal produced by the second buffer 1421. The first buffer 1420 and the second buffer 1421 are operational amplifiers.

Moreover, the liquid crystal of the display panel 10 needs to perform polarity inversion for preventing charge accumulation, which will deteriorate the display quality. Thereby, the driving circuit according to the present invention further comprises a second pre-charge power supply VSS and a second pre-charge switch 141. The driving circuit provides the first pre-charge power supply AVDD or the second pre-charge power supply VSS to the capacitor 100 via the first pre-charge switch 140 and the second pre-charge switch 141 according to the polarity inversion requirement of the liquid crystal of the display panel 10. The first pre-charge power supply AVDD and the second pre-charge power supply VSS can be coupled to any power supply of the display.

Figure 7:
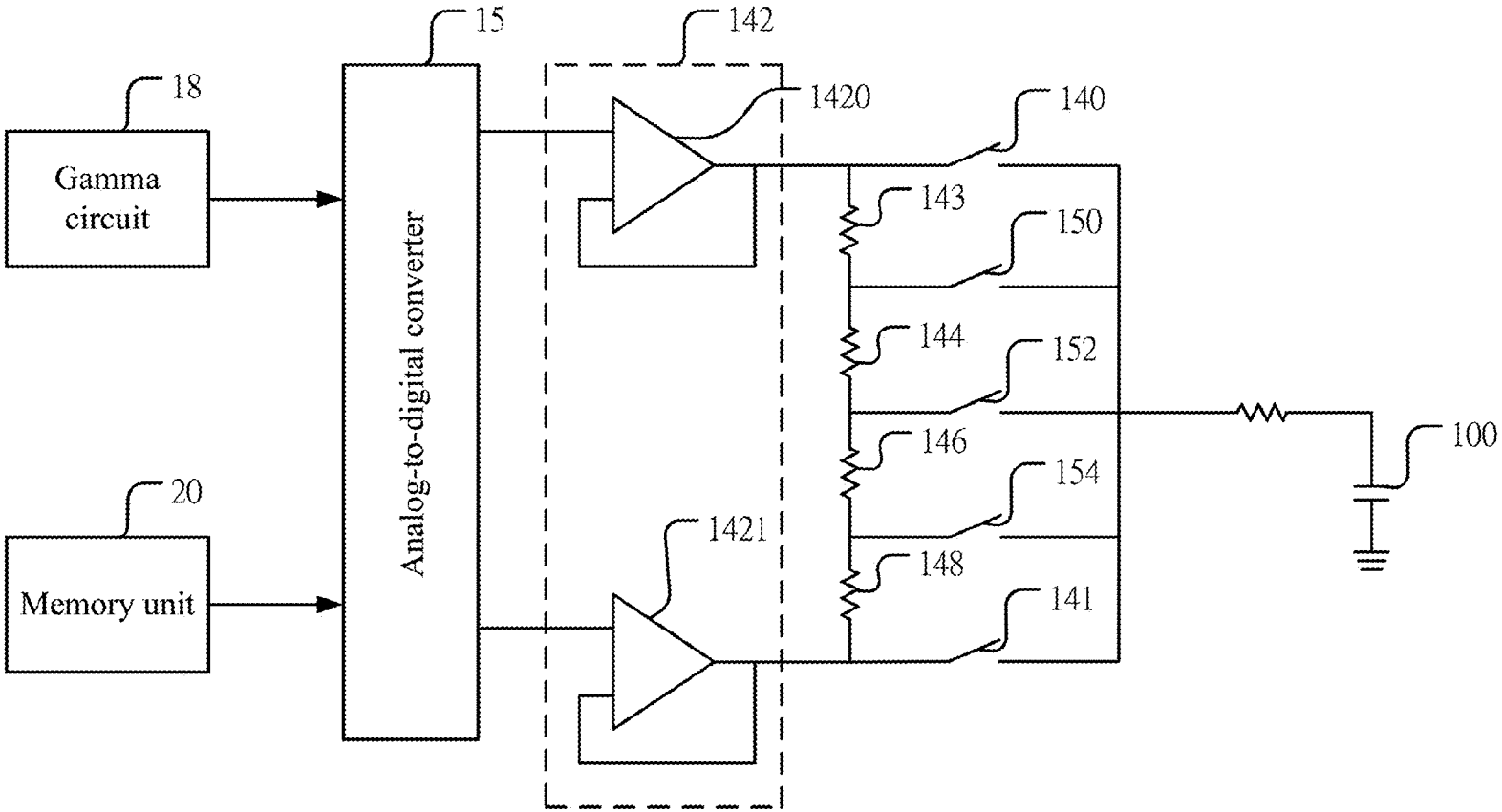
FIG. 7 shows a block diagram according to another preferred embodiment of the present invention.

FIG. 7 shows a block diagram according to another preferred embodiment of the present invention. As shown in the figure, the difference between the present preferred embodiment and the one in FIG. 5 is that, the first pre-charge power supply AVDD and the second pre-charge power supply VSS according to the present preferred embodiment are coupled to output terminals of the first buffer 1420 and the second buffer 1421, respectively. Thereby, during the process the driving circuit pre-charges by means of the first pre-charge power supply AVDD or the second pre-charge power supply VSS, overcharge phenomenon will not occur owing to long pro-charge time. Besides, the control of switching time can be simplified as well.

To sum up, the driving circuit for a display panel according to the present invention charges a capacitor of a display panel via a pre-charge switch and using a pre-charge power supply. Then, one of a plurality of driving signals produced between a plurality of resistive devices according to a buffer signal charges capacitor. Thereby, the driving time can be shortened, and the power of the display can be saved by avoiding power consumption on resistors.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for a display panel, comprising:

a pre-charge power supply;

a pre-charge switch, coupled between the pre-charge power supply and a capacitor of the display panel;

a buffer circuit, used for buffering a data signal and producing a buffer signal; and a plurality of resistive devices, connected in series and coupled to the buffer circuit, and producing a plurality of driving signals between the plurality of resistive devices according to the buffer signal;

wherein the driving circuit first closes the pre-charge switch to make the pre-charge power supply charge the capacitor, and then one of the plurality of driving signals charges the capacitor.

2. The driving circuit for a display panel of claim 1, and applied to a data driving circuit of the display panel.

3. The driving circuit for a display panel of claim 1, and further comprising an analog-to-digital converter, used for converting an input signal and producing the data signal.

4. The driving circuit for a display panel of claim 1, and further comprising a Gamma circuit, producing and transmitting the input signal to the analog-to-digital converter according to a Gamma curve.

5. The driving circuit for a display panel of claim 1, wherein the driving circuit provides a positive-voltage signal or zero-voltage signal to the capacitor according to the polarity inversion requirement of the display panel.

6. The driving circuit for a display panel of claim 1, and further comprising a plurality of switches, one end of switches coupled between the plurality of resistive devices, respectively, the other end of the switches coupled to the display panel, one of the plurality of switches being closed according to a control signal, and producing and transmitting the driving signals to the capacitor.

7. The driving circuit for a display panel of claim 6, and further comprising an analog-to-digital converter, producing the control signal according to an input signal for closing one of the plurality of switches.

8. The driving circuit for a display panel of claim 1, wherein the buffer circuit comprises:

a first buffer, used for buffering the data signal, and producing a first buffer signal; and a second buffer, used for buffering the data signal, and producing a second buffer signal.

9. The driving circuit for a display panel of claim 1, wherein the resistive device is a resistor.

10. The driving circuit for a display panel of claim 1, wherein the second buffer is an operational amplifier.

11. The driving circuit for a display panel of claim 1, wherein the first buffer is an operational amplifier.

* * * * *